US006186246B1

(12) United States Patent
Muuttonen et al.

(10) Patent No.: US 6,186,246 B1
(45) Date of Patent: Feb. 13, 2001

(54) METHOD FOR ADJUSTING DRILLING OF DRILLING MACHINE AND ROCK DRILL

(75) Inventors: Timo Muuttonen, Siuro; Aimo Helin; Timo Kiikka, both of Tampere; Jorma Mäki, Mutala; Pekka Salminen, Tampere, all of (FI)

(73) Assignee: Tamrock Oy (FI)

( * ) Notice: Under 35 U.S.C. 154(b), the term of this patent shall be extended for 0 days.

(21) Appl. No.: 09/051,616

(22) PCT Filed: Oct. 9, 1996

(86) PCT No.: PCT/FI96/00528

§ 371 Date: Sep. 4, 1998

§ 102(e) Date: Sep. 4, 1998

(87) PCT Pub. No.: WO97/13621

PCT Pub. Date: Apr. 17, 1997

(30) Foreign Application Priority Data

Oct. 10, 1995 (FI) ..... 954821

(51) Int. Cl.[7] ..... B25D 17/24

(52) U.S. Cl. ..... 173/1; 173/90; 173/162.1; 173/210

(58) Field of Search ..... 173/212, 210, 173/1, 162.1, 105, 90; 92/85 R, 85 B

(56) References Cited

U.S. PATENT DOCUMENTS

| | | | | |
|---|---|---|---|---|
| 1,715,359 | * | 6/1929 | Hansen | 173/105 |
| 4,366,868 | * | 1/1983 | Salmi | 173/90 |
| 4,624,325 | * | 11/1986 | Steiner | 173/212 |
| 4,934,465 | * | 6/1990 | Salmi et al. | 173/210 |
| 4,993,504 | * | 2/1991 | Rodert et al. | 173/212 |
| 5,351,763 | | 10/1994 | Muuttonen | 173/210 |
| 5,520,254 | * | 5/1996 | Weber | 173/212 |

FOREIGN PATENT DOCUMENTS

| | | |
|---|---|---|
| 2221418 | 2/1990 | (GB) . |
| 9112934 | 9/1991 | (WO) . |

* cited by examiner

*Primary Examiner*—Peter Vo
*Assistant Examiner*—Jim Calve
(74) *Attorney, Agent, or Firm*—Ladas and Parry

(57) ABSTRACT

A method for adjusting percussion pressure and a drilling machine. In the method the percussion power of a drilling machine is adjusted by moving a shank in the longitudinal direction of the drilling machine forwards when a smaller percussion power is to be transferred from the percussion piston to the shank. The drilling machine comprises at least two groups of pistons moving in the axial direction of the drilling machine, the pistons being connected to act on the shank by means of a pressure medium acting behind the pistons towards the front end of the drilling machine. The drilling machine comprises at least two separate groups of pistons whose travel with respect to one another is different and where pressure medium channels separate from one another lead to the cylinder spaces of both piston groups.

13 Claims, 4 Drawing Sheets

METHOD FOR ADJUSTING DRILLING OF DRILLING MACHINE AND ROCK DRILL

BACKGROUND OF THE INVENTION

The present invention relates to a method for adjusting drilling of a drilling machine in a drilling machine comprising a frame, a percussion piston arranged to the frame and moving in the longitudinal direction of the frame, an absorber situated in the front end of the travel of the piston portion of the percussion piston, a shank situated in the axial extension of the percussion piston and at least two pistons arranged to the frame moveable in its axial direction, the pistons being situated in axial cylinder spaces formed around the shank and arranged to act on the shank and push it towards the front portion of the drilling machine by means of a pressure medium acting on the rear surface of the pistons, whereby at least during drilling such a pressure of pressure medium is set to act on the rear surface of the pistons that the total force of all the pistons acting on the shank and pushing it forwards exceeds feed force acting on the drilling machine during drilling, wherefore some of the pistons are pushed to the foremost position of their travel by means of the pressure medium, whereby the shank is at its optimal percussion point when being supported by them.

The present invention also relates to a drilling machine which drilling machine comprises a frame, a percussion piston arranged to the frame and moving in the longitudinal direction of the frame, an absorber situated in the front end of the travel of the piston portion of the percussion piston, a shank situated in the axial extension of the percussion piston, and an axial bearing arranged to the frame for receiving axial forces directed to the frame via the shank, which axial bearing is formed of at least two pistons which are placed in the frame into axial cylinder spaces formed around the shank and arranged to act on the shank and push it towards the front portion of the drilling machine by means of a pressure medium acting on the rear surface of the pistons, whereby at least during drilling such a pressure of pressure medium is set to act on the rear surface of the pistons that the total force of all the pistons acting on the shank and pushing it forwards exceeds the feed force acting on the drilling machine during drilling and whereby the travel of some of the pistons towards the front portion of the drilling machine is restricted in such a manner that when said pistons are in their foremost position, the shank is essentially situated at its optimal percussion point when being supported by them.

When drilling holes with a rock drill, drilling conditions vary in various ways and in some situations it is necessary to be able to adjust fast and effectively the percussion power of the rock drill or other factors having an effect on drilling. In prior art solutions, percussion power is adjusted by adjusting the pressure of the pressure fluid in the percussion machinery, which is, however, quite difficult to realize accurately and in a controlled manner. Further, in prior art solutions, the position of the shank with respect to the percussion piston is always to be kept at a certain so-called optimal percussion point where as great a portion of percussion power as possible moves to the shank and via the shank through the drill rod to the drill bit. Finnish Patent 84,701 discloses a solution where the position of the shank is set by using several pistons, the pressure acting on which together pushes the shank into an optimal percussion point, but allows it to move backwards by means of a strong return pulse and to receive thus the stress created. In said Finnish Patent some of the pistons can also move farther than the others towards the front end of the drilling machine and thus follow that shank, whereby they receive the return movement and absorb it at an earlier stage during the return pulse.

SUMMARY OF THE INVENTION

In prior art solutions, the adjustment of drilling is difficult and the object of this invention is to provide a method and drilling machine where drilling can be easily adjusted as desired. The method according to the invention is characterized in that the pressure acting on at least some of the pistons is adjusted for providing a desired drilling situation.

The drilling machine according to the invention is characterized in that it comprises at least two pistons, pressure channels separate from one another leading to the pressure spaces behind the pistons and means for feeding pressure fluid to the pressure spaces behind the pistons in such a manner that a pressure is acting on them irrespective of one another.

The essential idea of the invention is that drilling is adjusted by adjusting the position of the shank with respect to the optimal percussion point and the force on the shank when it deviates from its optimal percussion point. In that case, in the adjustment of the percussion power, a desired amount of power is transferred via the shank to the drill rod and the remaining portion of the power is absorbed by the absorber in the front end of the travel of the percussion piston. Similarly, when rock contact of a drill bit is to be adjusted, the pressure acting behind the pistons is kept such that a smaller pressure than feed force is behind the pistons which are capable of moving forwards from their optimal percussion point, the pressure being variable according to the number of drill rods used in long hole drilling in such a manner that at the arrival of a percussion pulse, the drill bit can always be kept as desired in contact with the rock to be drilled without any essential power loss to the absorber. The method can be realized most simply by using several pistons with different travel, the travel of the pistons to the front end of the drilling machine being appropriately restricted. In that case, when feeding a pressure fluid of a suitable pressure behind pistons with different travel, the shank can be moved forwards as desired. An advantage of the invention is that by using pistons moveable to different travel, the shank can be moved mechanically into a desired percussion point that is either the optimal percussion point or one deviating from it. Because the position of the percussion point is precisely determined for all situations, power transfer and thus the percussion power of the machine can be calculated accurately and dimension it according to desired properties during manufacturing. The adjustment of drilling is fast and simple as it can be realized only by adjusting the pressure of pressure fluid acting on the pistons that support the shank.

BRIEF DESCRIPTION OF THE DRAWINGS

In the following, the invention will be explained in more detail with reference to the appended drawings, in which.

DETAILED DESCRIPTION

Figure 1:
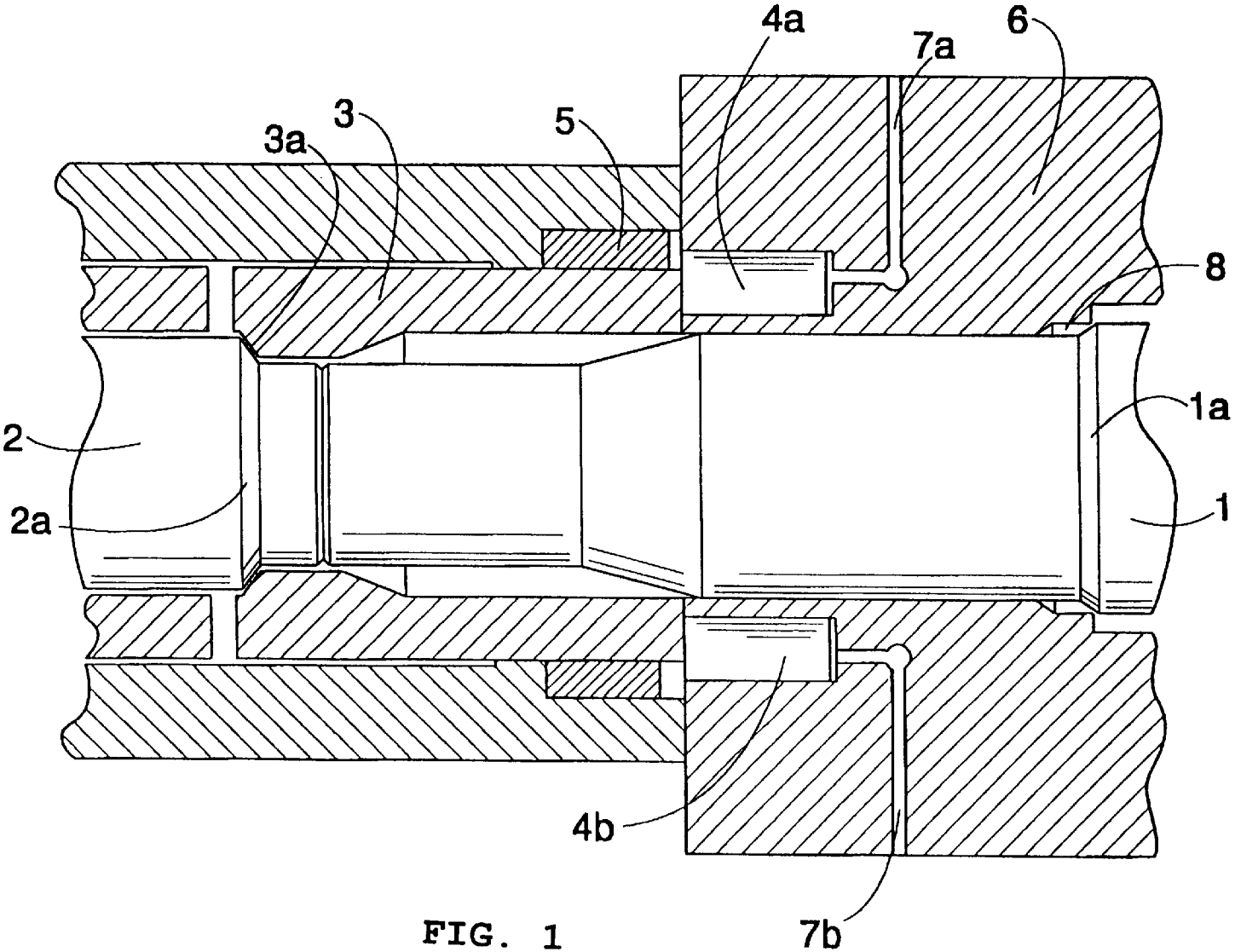
FIG. 1 shows a schematic view of one construction in a drilling machine suitable for realizing the method according to the invention.

FIG. 1 shows a schematic view of a drilling machine comprising a percussion piston 1 and a shank 2 situated coaxially with the percussion piston. The shank 2 is rotated in a manner known per se by means of a rotation motor (not shown) by rotating a bushing 3 around the shank 2 which can move in the axial direction with respect to the bushing. The bushing 3 supports the shank 2 on a slanted supporting surface 3*a* that is in contact with a corresponding slanted supporting surface 2*a* of the shank. There are several pistons 4*a* and 4*b* behind the bushing 3 connected to or indirectly acting mechanically on the rear surface of the bushing 3. A restricting ring 5 is disposed around the bushing 3 restricting the movement of the pistons 4*a* and 4*b* towards the front end of the drilling machine. The pistons 4*a* and 4*b* are situated in cylinder spaces which have been drilled to the frame 6 and which are parallel to the axis of the percussion piston 1 and pressure fluid channels 7*a* and 7*b* lead to the cylinder spaces. There are several pistons 4*a* and 4*b* in the frame 6 of the drilling machine and they are divided into groups in such a manner that there are at least two separate groups whose travel towards the front end of the drilling machine is different. This construction is described in more detail in Finnish Patent 84,701, the contents of which are considered to be included in the specification of the present application. Further, the drilling machine comprises an absorber 8 in the front end of the cylinder space of the percussion piston 1, that is, in the travel of the piston portion 1*a* of the percussion piston 1 in the front end of the drilling machine and the front end of the piston portion 1*a* strikes the absorber when the percussion piston for some reason should strike past its normal optimal percussion point. This construction is generally known per se and used to stop the drilling machine from becoming broken and therefore it is not explained in more detail herein.

By means of the method according to the invention, the position of the shank of the drilling machine and thus e.g. percussion power or rock contact of the drill bit can be adjusted by using this construction. This takes place so that during normal drilling the pressure fed behind the pistons is kept such that the pistons push the shank to its optimal percussion point, but cannot push it any farther as the power caused by pistons 4*b* with longer travel via the bushing 3 to the shank 2 is smaller than the feed force of the drilling machine. During the stroke, when the body of the drilling machine does not have time to move with the drill rod, the pistons follow the shank and thus support the drill bit against the rock by the pressure of the force set to act on them, until the drilling machine has had time to move. When the percussion power is to be diminished, at least such a pressure of the pressure fluid is fed behind the pistons 4*b* that the pistons 4*b* with longer travel are able to push the shank their allowed travel forwards, whereby the percussion piston 1 strikes the shank 2 later than usual and thus some of its percussion energy is absorbed in the absorber 8 of the percussion piston. When three different percussion powers, for example, are to be used, three piston groups with a different percussion length are also used, whereby by appropriately feeding pressure behind the pistons, the shank can be moved to a desired power transmission position.

Figure 2:
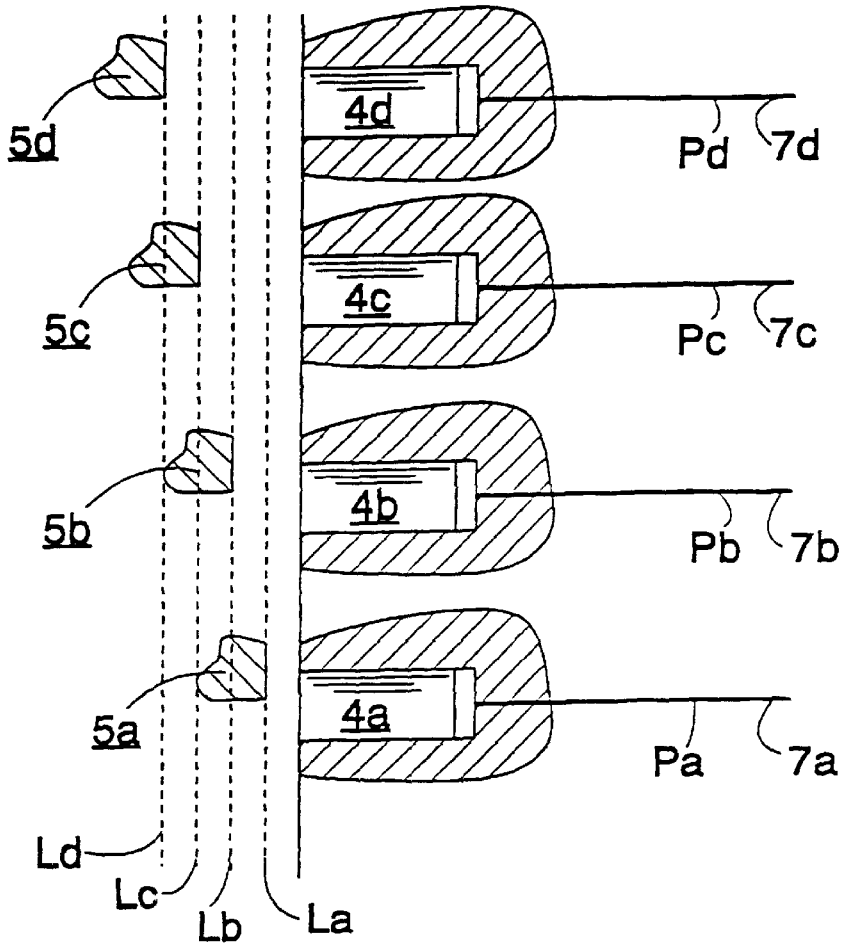
FIG. 2 shows a schematic, sectional view of the adjustment of the drilling machine according to FIG. 1 in different power adjustment situations.

FIG. 2 shows a schematic view of the adjustment of percussion power in another way. In this case, pistons with different travel, which are indicated by numerals 4*a* to 4*d*, are each connected to a specific group and to a specific feed channel 7*a* to 7*d* of pressure fluid separate from other piston groups. In the figure, one piston 4*a*, 4*b*, 4*c* and 4*d*, respectively, refers schematically to all pistons of one group. The figure also shows schematically by numerals 5*a* to 5*d* the portions of the restricting ring 5 that restrict the travel of different pistons 4*a* to 4*d* in different ways. Similarly, the figure also shows with broken lines La to Ld the travel which each piston or piston group can move with respect to one another and broken line La describes the position corresponding to the optimal percussion length of the shank and lines Lb to Ld positions corresponding to the transfer of pistons 4*b* and 4*c* that have moved forwards with respect to the optimal percussion point where the piston portion 1*a* of the percussion piston 1 strikes a shorter or a longer distance, respectively, to the absorber 8 or the percussion piston has otherwise moved away from its optimal percussion point. When the cross section of the pistons with respect to the hydraulic pressure to be used is dimensioned appropriately, a pressure fluid Pa to Pd with a different pressure can be fed behind each piston group independently of the others and then it can be easily selected with which travel of the pistons 4*a* to 4*d* the percussion point of the shank is to be set. Correspondingly, this can be attended to by maintaining the same pressure behind all pistons, whereby by selecting appropriately the area and the number of pistons and by adjusting the active pressure, the desired forces are obtained for the desired piston groups.

The adjustment of percussion power is carried out automatically by adjusting the values of the pressure of the pressure fluid acting behind the pistons 4*a* to 4*d* suitable ones with respect to the feed force of the drilling machine. In that case, if the penetration of the drilling tool is for some reason, e.g. because of poor rock material or the like, greater than the feed speed, the shank moves because of the pressure acting behind the pistons 4*a* to 4*d* forwards to a position where the percussion point is no longer optimal. Depending on behind which pistons pressure of pressure fluid is fed or how great a pressure is set behind the pistons, the shank either moves somewhat forwards from its optimal percussion point, but only such a distance so that the percussion piston does not strike the absorber or, if it moves the distance specified by the pistons 4*c* and 4*d*, it partly strikes the absorber 8. The farther the shank can penetrate, the smaller the transfer of percussion power will be between the percussion piston 1 and the shank 2. When starting drilling or with certain types of rock or when the conditions thus require, transfer capacity can be selected by using sufficient pressure behind a desired piston group 4*a* to 4*d* or behind all groups, whereby a sufficiently small percussion power is provided for each differing drilling situation.

Figure 3:
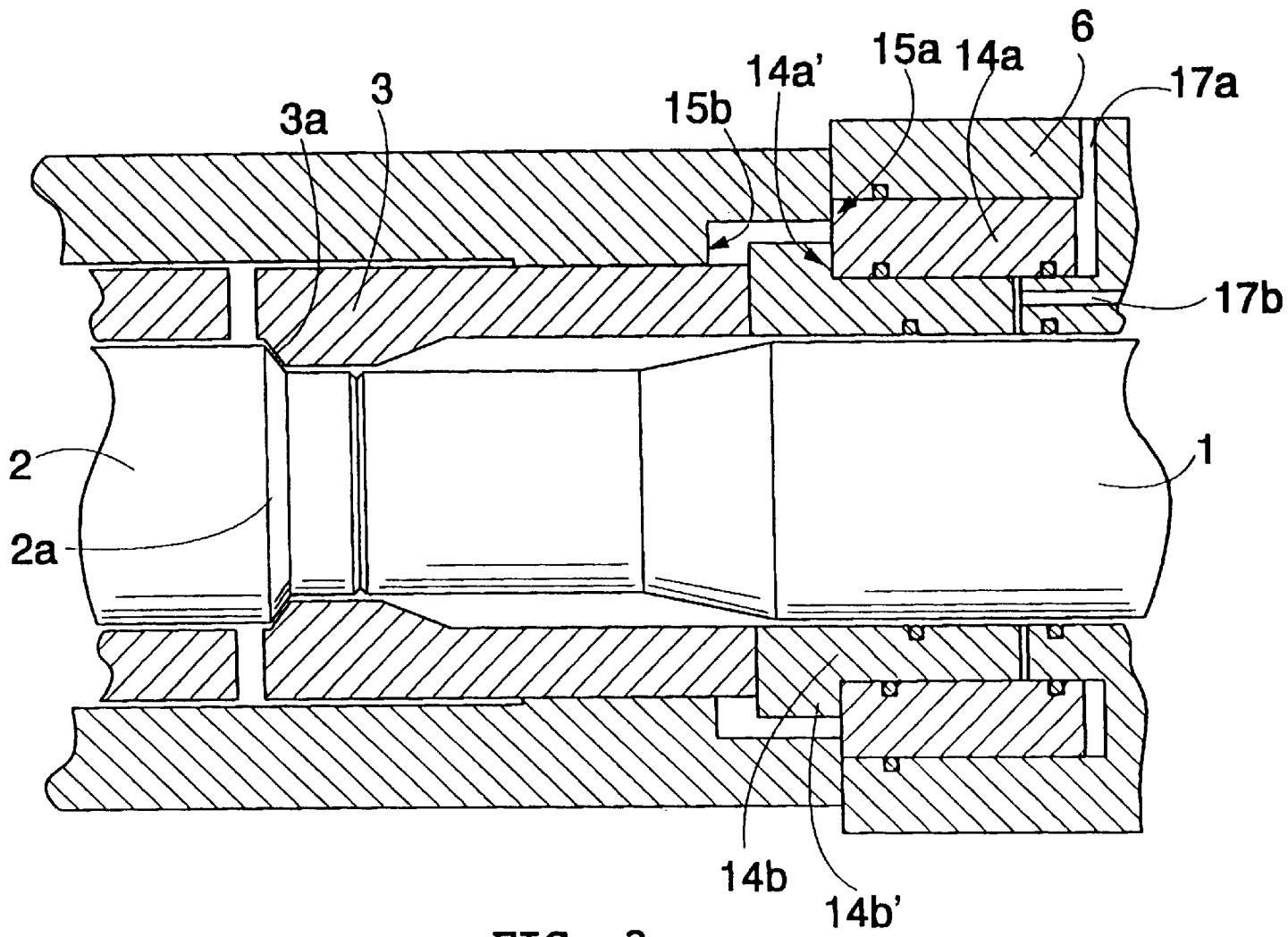
FIG. 3 shows a schematic, sectional view of a second construction in a drilling machine suitable for realizing the method according to the invention.

FIG. 3 shows a schematic view of a second construction in a drilling machine suitable for realizing the invention, whereby corresponding parts in FIG. 3 are referred to by the same numerals as in FIG. 1. In the embodiment shown in FIG. 3, bushing-like pistons are used instead of several separate pistons and the bushing-like pistons are placed around the percussion piston coaxially with it. In this case, pistons 14*a* and 14*b* are placed in such a manner that the piston 14*a* is outmost and a pressure channel 17*a* leads to it by means of which channel the piston 14*a* can be pushed forwards. The piston 14*a* stops at an abutment surface 15*a* in the frame, whereby when the piston is in that position and when the shank 2 is supported by the piston 14*a*, it is at its optimal percussion point. The piston 14*b* is coaxially inside the piston 14*a* and behind it pressure fluid enters along a channel 17*b*. The piston 14*b* also has a projection 14*b*' extending to the supporting surface 14*a*' in the front of the piston 14*a* in such a manner that the piston 14*a* can push the piston 14*b* towards the front end of the shank. The piston 14*b* pushes the shank with the help of the bushing 3. Correspondingly, when the shank 2 pushes the piston 14*b* backwards, it is pushing the piston 14*a* by means of its projections. Furthermore, the travel of the piston 14*b* towards the front portion of the drilling machine is restricted by an abutment surface 15*b*, whereby when the piston 14*b* is against the abutment surface 15*b*, the shank 2 is at a new percussion point differing from the optimal percussion point.

In a normal situation, the pistons 14*a* and 14*b* are as shown in the figure when the shank is at the optimal percussion point. If the pressure behind the piston 14*b* is added through the channel 17*b*, the pressure will, when it rises high enough, cause a force exceeding the feed force of the drilling machine and move the shank and the drilling machine with respect to one another in such a manner that the shank 2 is in the front of its normal percussion point.

This embodiment can be realized in different ways, whereby there may be a separate transmission ring or separate pins that transmit power from the piston 14*b* to the bushing 3. Similarly, the pistons 14*a* and 14*b* can be in the way shown in the figure or in the opposite way in such a manner that the piston 14*b* is outermost and the piston 14*a* is innermost. Further, the pistons may also be one after the other in the axial direction of the shank. Similarly, several pistons may be annularly concentric as shown in the figure and cylindrical pistons of FIG. 1 can also be used at the same time as and in addition to annular pistons.

Figure 4:
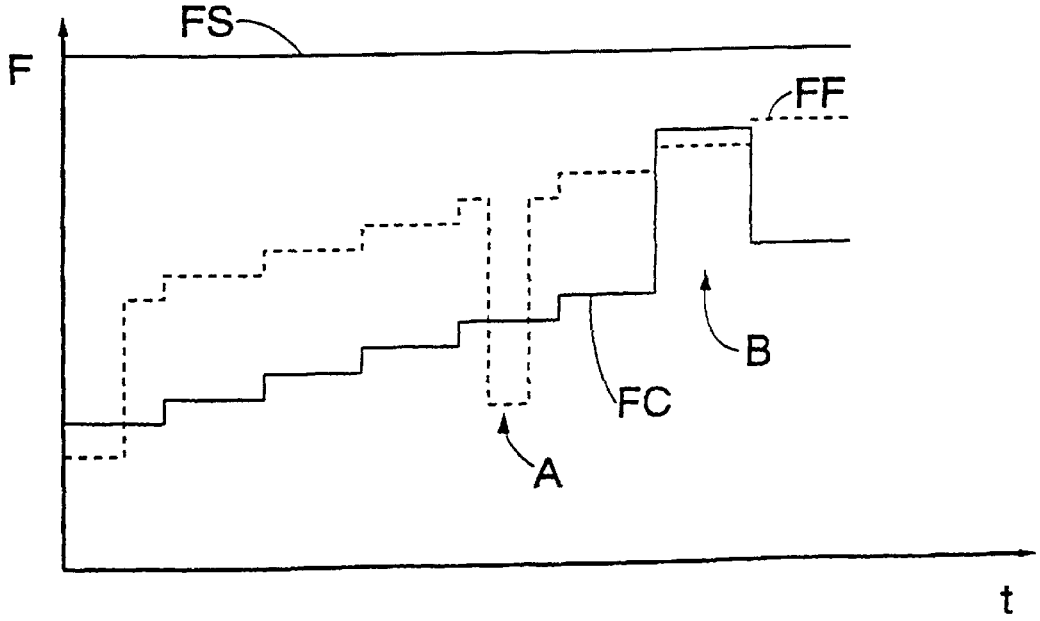
FIG. 4 is a graphical illustration which shows a schematic, sectional view of forces caused by pressures present in connection with one realization of the method according to the invention.

FIG. 4 shows a schematic view of forces caused in connection with one embodiment of the invention by pressure changes when drilling upwards with long hole drilling. The force shown with a horizontal line FS in the figure is caused by the pressure behind the pistons 4*a*, 14*a* which support the shank at its optimal percussion point. Stepped line FC describes the sum of the forces caused by means of the pressure set behind the pistons 4*b* to 4*d*, 14*b* which are capable of moving towards the front end of the drilling machine during drilling. Whenever one drill rod is added to the drill rod set, the pressure behind the pistons 4*b* to 4*d*, 14*b* is raised in such a manner that the addition of mass is compensated by the addition of pressure and thus the drill bit is supported in the front of the percussion point essentially with a constant power. The sum of the force caused by the pressures behind the pistons 4*a*; 14*a* and 4*b* to 4*d*; 14*b*, respectively, is greater than feed force and thus it is able to retain the shank at the optimal percussion point, but the sum of the forces caused by the pistons 4*b* to 4*d*; 14*b* remains to be at a smaller value than the feed force of the drilling machine. The feed force is described by broken line FF, whereby the feed force is kept at the beginning of drilling so small that the sum of the forces caused by the pistons 4*b* to 4*d* moves the shank forwards and the percussion piston strikes the absorber. In this situation, as shown in the figure, the force caused by the piston 4*d* stays on to support the drill bit in the front of the percussion point and enables the drilling to be controlled. Percussion power can thus be adjusted until drilling has started and normal drilling has begun. On the other hand, it happens sometimes in connection with normal drilling that rock is soft or broken, which can be seen in the figure when broken line FF falls abruptly and rises up after that at point A. In this situation, the active force of the pistons 4*b* to 4*d*; 14*b* exceeds the feed force, whereby the shank penetrates into a new percussion point and the percussion piston strikes the absorber and the percussion power will diminish until ordinary rock is reached. When adding drill rods, the feed force is also added to compensate for the mass, whereby a stepped line is formed as shown in the figure.

Point B is in a situation where the drill rod has started to resonate or it is known to resonate. In this situation, the force pushing the pistons 4*b* to 4*d* forwards is adjusted to be greater than the feed force by adjusting the pressure. Here the travel of the pistons 4*b* is restricted in such a manner that the movement of the shank forwards does not move the percussion piston to the absorber at the end of the stroke so that the percussion power will not change essentially. As a result of the moving of the shank, the percussion length of the percussion piston and thus the frequency of percussion change and resonance is thus avoided. On the other hand, the pressure level of the pistons 4*c* and possibly of the piston 4*d* and the force caused by it is raised at the same time so that bit contact, that is, supporting force in the front of the percussion point remains essentially unchanged. After adding one or more drill rods, a normal pressure level and thus the optimal percussion point of the shank for the stroke can be regained. Also, the pressure acting behind the pistons and retaining the shank at its normal percussion point can be adjusted by the number of the drill rods to be used, whereby straight line FS will be stepped in such a manner that the recoil receiving difference force of the piston force and the feed force is constant, for example.

Figure 5:
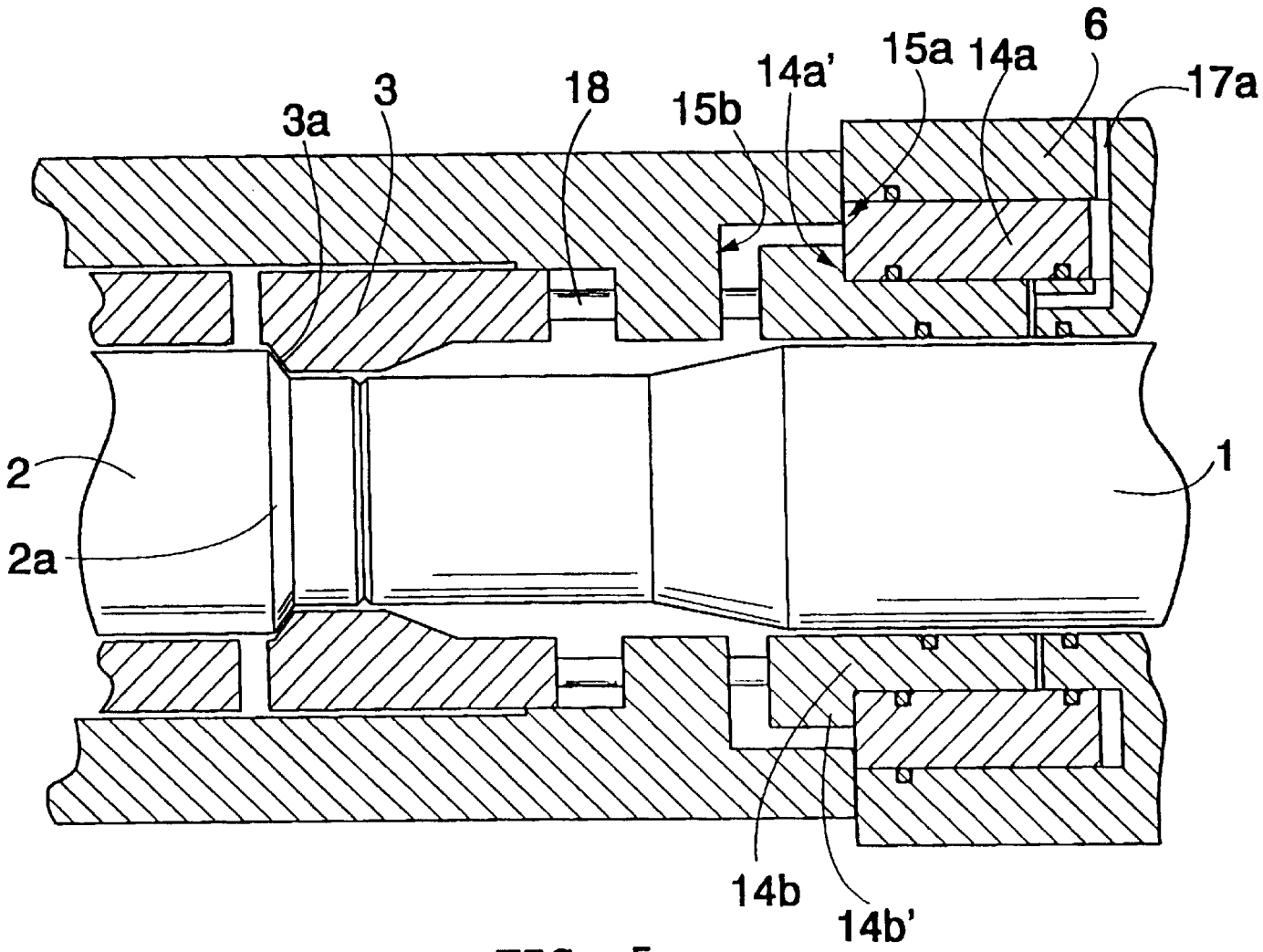
FIG. 5 shows a schematic view of a third construction in a drilling machine suitable for realizing the method according to the invention.

FIG. 5 shows a schematic view of the embodiment of the invention corresponding to FIG. 3 in other respects but that a uniform pressure acts there behind the pistons 14*a*, 14*b* at the same time. In that case, the adjustment of the percussion point of the shank 2 and percussion adjustment is carried out only by adjusting the pressure of the pressure fluid acting through the channel 17*a*, an increase of which pressure will make the piston 14*b* to push the shank 2 forwards. In addition, this embodiment comprises separate transmission parts 18 between the piston 14*b* and the bushing acting on the shank 2 for transmitting power forwards from the piston 14*b* to the bushing 3 and further via the bushing to the shank 2.

The invention has been described and shown in the description above and the drawings only by way of example, and it is in no way restricted to this example. Different automatic pressure adjustment methods and apparatuses can be combined, when desired, to the method according to the invention for attaining automatic power adjustment. Similarly, the same, pressure can be fed behind all the pistons, whereby the required transfer of the shank forwards requires a sufficient pressure with respect to the number of the pistons which are capable of moving forwards. The pistons can be, as shown in drawings, of a singleit comprises at least two pistons, pressure channels separate from one another leading to the pressure spaces behind the pistons and means for feeding pressure fluid to the pressure spaces behind the pistons in such a manner that a pressure is acting on them irrespective of one another construction but also different piston constructions which have between the piston portions and the shank separate piston portions and different transmission bushings and bearing portions through which the pistons act on the shank mechanically and push it forwards.

What is claimed is:

1. A method for adjusting drilling of a drilling machine, said drilling machine comprising a frame, a percussion piston supported in the frame for movement along a longitudinal axis, an absorber disposed at a front end of travel of a piston portion of the percussion piston so as to be contacted by the piston portion at the front end of travel of the piston portion, a shank supported in the frame in axial extension of the percussion piston so as to be impacted by said percussion piston in a working stroke thereof and at least two control pistons supported in the frame for longitudinal movement, said control pistons being disposed in cylinder spaces arranged around the longitudinal axis for moving the shank longitudinally to a selected percussion point at which the percussion piston impacts against the shank, said method comprising:

applying pressure to each respective control piston to produce a respective stroke of each control piston, regulating the stroke of each respective control piston so that the control pistons have respective strokes, which are different from one another, to move the shank to corresponding different respective percussion points, and moving the shank to said different selected percussion points by the respective control pistons by introducing pressure medium into said cylinder spaces at respective different controlled pressures so that the control pistons move the shank to respective percussion points in accordance with the strokes of said pistons whereby the shank is movable to a number of selected percussion points by the different control pistons.

2. A method as claimed in claim 1, comprising moving the shank to an optimum percussion point by a first of said control pistons and moving the shank by a second of said control pistons to a different percussion point.

3. A method as claimed in claim 2, comprising arranging the control pistons in first and second groups each respectively including said first and second pistons and supplying the cylinder spaces of the control pistons in each of said groups with pressure medium at the same pressure within each group, the pressure of the pressure medium in the first and second groups being different from one another.

4. A method as claimed in claim 2, comprising transmitting force from the control pistons to the shank, to move the shank, via a bushing interposed between the control pistons and the shank, the bushing being slidably supported in the frame for movement in the longitudinal direction.

5. A method as claimed in claim 2, wherein when the shank is moved by said second control piston from said optimum percussion point to said different percussion point, the percussion piston impacts against the shank with a reduced impact force.

6. A method as claimed in claim 2, wherein the shank is moved by said second control piston a sufficient distance away from said optimum percussion point, so that the percussion piston undergoes an increased stroke and strikes the absorber.

7. A method as claimed in claim 1, wherein a number of drill rods are utilized in drilling depending on hole length, and the method further comprises adjusting the percussion point of the shank by the control pistons depending on the number of drill rods.

8. A method as claimed in claim 1, wherein the pressure of the medium applied to the control pistons is sufficiently high so that a force applied by the control pistons to the shank is greater than a feed force of the drilling machine.

9. A drilling machine comprising a frame, a percussion piston supported in the frame for movement along a longitudinal axis, an absorber disposed at a front end of travel of a piston portion of the percussion piston, so as to be contacted by said percussion piston in a working stroke thereof, a shank supported in the frame in axial extension of the percussion piston so as to be impacted by said percussion piston in a working stroke thereof, and an axial bearing arranged in the frame for receiving axial forces applied to the frame via the shank during a drilling operation, said axial bearing comprising at least two control pistons supported in the frame for longitudinal movement, said control pistons being disposed in cylinder spaces arranged around the longitudinal axis for moving the shank longitudinally to respective selected percussion points at which the percussion piston impacts against the shank, said cylinder spaces of each of said at least two control pistons being connected by respective pressure channels to receive pressure medium from different pressure sources at different pressures to produce respective strokes for said control pistons to move the shank to respective selected percussion points, at least a first of said control pistons having a length of stroke to move the shank to an optimum percussion point at which a maximum impact force is applied to the shank by the percussion piston, and at least a second of said control pistons having a greater length of stroke than that of said first control piston to move the shank away from said optimum percussion point to another percussion point at which the impact force of the percussion piston on the shank will be reduced.

10. A drilling machine as claimed in claim 9, wherein the shank is moved sufficiently far from said optimum percussion point by said second control piston that a stroke of the percussion piston is such that the percussion piston impacts against said absorber and reduces impact force on the shank.

11. A drilling machine as claimed in claim 9, wherein said control pistons are arranged in a plurality of groups, the control pistons in each group being connected to receive the same pressure of the pressure medium, the pressure of the pressure medium to the respective groups being different.

12. A drilling machine as claimed in claim 9, wherein a number of other of said control pistons displace the shank successively greater distances away from said optimum percussion point.

13. A drilling machine as claimed in claim 9, comprising a bushing between said control pistons and said shank to transmit force between said control pistons and said shank.

* * * * *